United States Patent [19]

Hilaire et al.

[11] 4,432,793

[45] Feb. 21, 1984

[54] FERROALLOY FOR THE TREATMENT OF CAST METALS AND PROCESS

[75] Inventors: Pierre Hilaire, Louveciennes, France; Franz Lietaert, Zwijnaarde, Belgium; Claude Staroz, Puteaux, France; Walter Schumacher, Dusseldorf, Fed. Rep. of Germany

[73] Assignee: Societe Nobel Bozel, Puteaux, France

[21] Appl. No.: 403,726

[22] Filed: Jul. 30, 1982

[30] Foreign Application Priority Data

Aug. 4, 1981 [FR] France ..... 81 15110

[51] Int. Cl.[3] ..... C22C 33/08

[52] U.S. Cl. ..... 75/130 R; 75/53; 75/123 R

[58] Field of Search ..... 75/53, 130 R, 123; 420/578

[56] References Cited

U.S. PATENT DOCUMENTS 2,792,300 5/1957 Livingston ..... 75/130 R 2,841,488 7/1958 Morrogh ..... 75/130 R

*Primary Examiner*—Peter D. Rosenberg

*Attorney, Agent, or Firm*—McAulay, Fields, Fisher, Goldstein & Nissen

[57] ABSTRACT

A ferroalloy for the treatment by inoculation of cast iron with spheroidal graphite comprises from 0.005 to 3% by weight of at least one metal of the rare earth group and from 0.05 to 3% by weight of at least one element taken from the group comprising bismuth, lead and antimony, the remainder being essentially the silicon and iron normally present in the ferroalloys used for inoculating the cast metals.

This ferroalloy may be used for the treatment by inoculation of cast metals with spheroidal graphite having to be used rough cast.

10 Claims, 2 Drawing Figures

N
1000
500

$N_B$
$N_A$
0
0,2
0,35
0,5
0,7
1,0
1,3
i%

N
P %

$P_E$
$P_B$
$N_B$
$N_E$
1000
500
50
25
0
0
1
3
5
7
8
9
11
$t_C$(mn)

FERROALLOY FOR THE TREATMENT OF CAST METALS AND PROCESS

BACKGROUND OF THE INVENTION

The present invention relates to a ferroally for the treatment by inoculation of cast iron with spheroidal graphite having to be used as cast, as well as to a process for treating the liquid cast iron with this ferroalloy.

Well known procedures for treating liquid cast iron in general which are carried out in the following order: carburization, desulfurization, spheroidizing, inoculation, most often comprise a post-inoculation treatment carried out with inserts of ferroalloy introduced into the molds to refine the structure by obviating the imperfections of the above-mentioned treatments carried out upstream.

The variable number of spheroids produced in moulding has different models of specifications; indeed the ferrite/pearlite ratio of the matrix is largely dependent on the structure of the graphite in cast iron of current chemical composition. It so happens that, for these cast iron, the desired morphology of the graphite is generally obtained directly by the spheroidizing treatment, either by an addition of magnesium or by an addition of ferroalloy containing magnesium. The quantity of spheroidizing ferroalloy is determined by well-known factors such as the sulfur contained in the base iron.

This constraint which determines the overall quantity of ferroalloy for treatment cannot enable the optimum quantity of each element constituting the alloy to be distinguished.

To complete the desired graphitic presentation, rare earth metals are then used which, in well metered quantities, have a particularly favourable and well known effect. Thus, in the majority of cases, the addition of rare earth metals to the cast iron is necessary to neutralize the contaminating elements which may be brought by the base materials. However, excessive addition of rare earths can produce mottled structures due for example to the carbides, by reason of the behaviour of the rare earth metals in the cast iron. They may also degenerate the spheroids of graphite and/or reduce the quantity thereof.

Whether the rare earth metals are a constituent part of the magnesium-based ferroalloys or whether they are incorporated directly in the liquid cast iron the dosages remain very tricky. This results in an often fluctuating yield which sometimes leads to the necessity of resorting to the use of inserts in order to post-inoculate in the moulds, and sometimes to the undesirable, detrimental appearance of forms of degenerated graphite in the solidified structure.

Furthermore, the action of bismuth, lead or antimony, as far as neutralizing the spheroidizing action is concerned, is well known. The increasing presence of these elements in the cast metal thus leads to the appearance of structures of degenerated graphite which, in the event of overdose, cannot always be prevented by the addition of rare earth metals. Thus, bismuth, lead or antimony may sometimes cause a considerable increase in the number of spheroids, but the capacity of these elements for degenerating the spheroidal structure of the graphite has, up to the present time, prevented general application thereof.

SUMMARY OF THE INVENTION

It is essentially an object of the present invention to overcome these drawbacks by the use of a ferroalloy as inoculating agent for cast iron with spheroidal graphite, enabling quantities of rare earth metals and of bismuth, which are well metered and neutral with respect to the spheroidizing action, to be simultaneously added after the spheroidizing treatment.

To this end, this ferroalloy for the treatment by inoculation of cast iron with spheroidal graphite is characterized in that it comprises from 0.005 to 3% by weight of at least one metal of the rare earth group and from 0.05 to 3% by weight of at least one element taken from the group comprising bismuth, lead and antimony, the remainder being essentially the silicon and iron normally present in the ferroalloys used for inoculating the cast iron.

It is also an object of the invention to provide a process for treating the liquid cast iron with the abovementioned ferroalloy as a unique inoculating treatment, this process being characterized in that well-metered quantities of rare earth metals with well- metered quantities of bismuth, lead or antimony are added, after the spheroidizing treatment of the cast iron, so that the sum of the rare earth metal elements is included between 0.005% and 0.1% by weight of the cast iron, whilst the sum of the elements bismuth, lead and antimony represents between 0.005% and 0.05% by weight of the cast iron.

The ferroalloy according to the invention presents several advantages. Firstly, by reason of its activity due to the originality of its composition, the use of this ferroalloy can be indexed with respect to the quality of the cast iron to be treated, coming into the ladle or mould without any subsequent addition. It may be used with fine granulometry at the inlet of the moulds or in grains at the inlet of the casting ladles. In each of these cases, the ferroalloy is preferably introduced mechanically in times and quantities determined by the sequence of treatment.

The process for treatment of the liquid cast iron with the ferroalloy according to the invention leads to savings in the heat treatments and reduction in times, a saving in ferroalloy inserts, indexation of the inoculation treatments and development of the cast iron with ferritic matrix of small thickness and high strength.

BRIEF DESCRIPTION OF THE DRAWINGS

The invention will be more readily understood on reading the following description with reference to the accompanying drawings, in which.

DESCRIPTION OF THE PREFERRED EMBODIMENTS

In all the examples which will be described hereinafter, all the percentages of the various components are given by weight.

In a first series of tests, the germinating powers are compared, for graphite, of an inoculating agent A of conventional composition based on 0.8 to 1.2% of CA; 4 to 5% of Al and 70 to 72% of Si and of ferroalloy B made according to the invention (based on 0.59% Ca; 0.23% Al; 0.44% rare earths; 0.49% Bi and 71% Si; the remainder being essentially Fe). The batches were constituted by a current hematite and ferroalloy which were melted in an induction furnace with neutral lining with a capacity of 65 kg.

After adjusting the chemical composition of the basic cast metal, the liquid bath was taken to a temperature of 1500° C. and treated with magnesium in the furnace by adding 0.85% of an alloy containing 13 to 17% Mg, about 85% Ni, without mischmetal or rare earths.

The cast metal thus treated was then poured into a casting ladle preheated by gas and inoculated at a temperature of 1400° C. Sheets 6 mm thick were cast immediately after inoculation. The final chemical composition, therefore after inoculation of the cast iron for all tests, corresponds to:

| % C | % Si | % Mn | % P | % S | % Ni | % Mg |
|---|---|---|---|---|---|---|
| 3.55–3.70 | 2.20–2.40 | ≦0.05 | 0.02–0.025 | ≦0.010 | 0.70–0.75 | 0.050–0.060 |

Table I indicates the variation in the mean number N of spheroids per square millimeter, measured in a transverse section of the 6 mm thick sheets, as a function of the percentage i of inoculating agent added, this being in the case of alloys A and B. These variations are illustrated by corresponding curves $N_A$ and $N_B$ of FIG. 1.

TABLE I

| Percentage of inoculating agent added. -(i)- | Mean number of spheroids per mm² in a transverse section of a 6 mm thick sheet -(N)- | |
|---|---|---|
| | Alloy A | Alloy B |
| 0.2 | 186 | 368 |
| 0.35 | 246 | 483 |
| 0.5 | 281 | 727 |
| 0.7 | 429 | 712 |
| 1.0 | 488 | 989 |
| 1.3 | 512 | 1238 |

Figure 1:
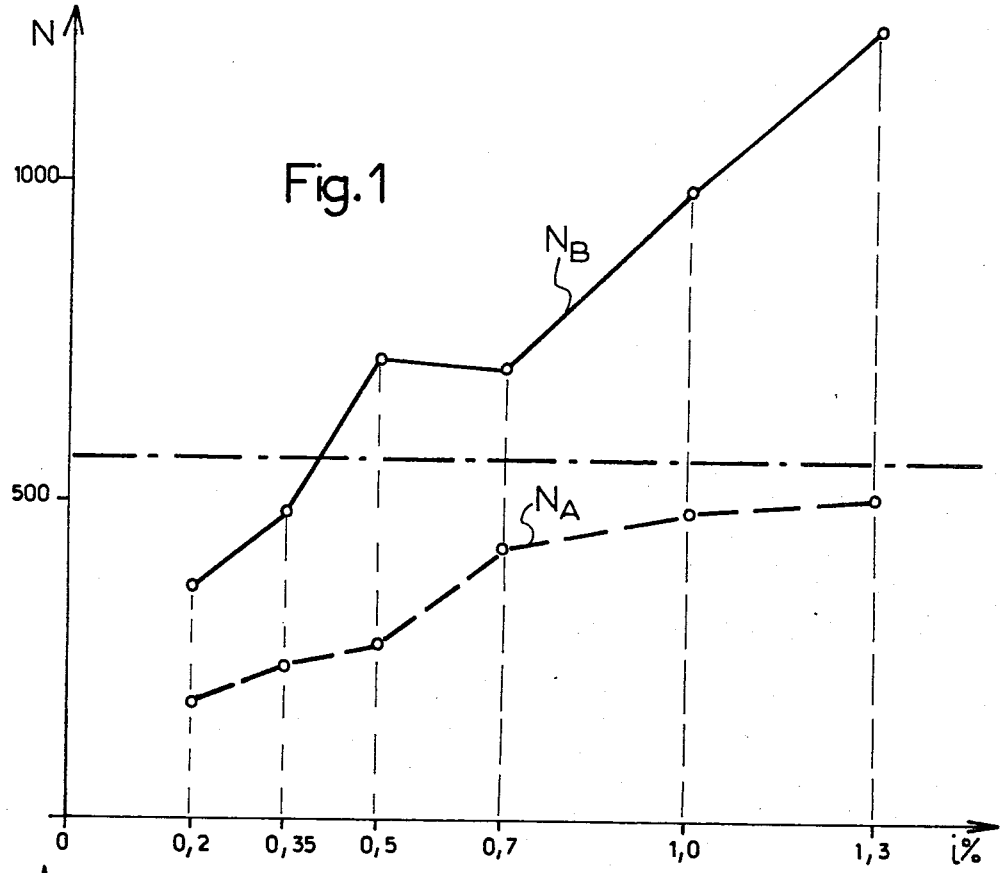
FIG. 1 is a diagram showing the variation of the mean number of spheroids per square millimeter, measured in a transverse section of a sheet of cast iron 6 mm thick, as a function of the percentage of respectively an inoculating agent of usual composition and an inoculating agent according to the invention.

The number of spheroids is counted with the aid of an optical microscope with a magnification of 250. With alloy B according to the invention, the absolute absence of any form of degenerated graphite will be observed, whatever the rate of adition of this alloy B. For the chemical composition of the cast iron chosen, the minimum number of spheroids necessary for guaranteeing, in as cast state, a free structure of carbides at the ends of the 6 mm sheets, is at about 570. FIG. 1 shows that, by applying alloy A of conventional composition, a completely gray structure is never attained.

For the second series of castings, the same final chemical composition of the cast iron has been chosen as for the first. For these castings, comparative tests have been made with inoculating agent A of conventional composition given above, and other inoculating agents, namely:

alloy C of composition: ferroalloy with 0.44% Ca; 1.9–2% Al; 0.26% rare earths and 73% Si; remainder: Fe.

alloy D: ferroalloy according to the invention with 0.9% Ca; 0.2% Al; 0.74% rare earths; 1.45% Bi and 72% Si; remainder Fe.

The fourth inoculating agent tested, corresponding to casting A4, was composed of pieces of pure Mischmetal and Bi-metal immersed in the liquid bath with the aid of a steel rod. The results of these tests are shown in Table II hereinbelow.

TABLE II

| No. of casting | Percentage and type of inoculating added | Mean number of spheroids/mm² in the sheet of 6 mm | 12mm | 24mm | HB10/3000/15 hardness in the 24 mm sheet |
|---|---|---|---|---|---|
| A1 | 0.2 of alloy A | 186 | 117 | 71 | 183 |
| A2 | 0.2 of alloy C | 205 | 123 | 70 | 186 |
| A3 | 0.2 of alloy D | 493 | 240 | 193 | 161 |
| A4 | 0.005 of mischmetal + 0.005 of Bimetal | (mottled) | (mottled) | 40 | 203 |

During casting A4, i.e. with 0.005% of mischmetal and 0.005% of Bimetal as inoculating agent, mottled structures were obtained, in the case of 6 and 12 mm sheets, of which the number of spheroids was not determined and with sheets of 24 mm, a small quantity of spheroids mostly irregular in form: 10% type I+85% type II+5% type V (qualification of the types of graphite according to specifications ASTM A247-67). Table II hereinabove shows that the conventional inoculating agents A and C are virtually equivalent. On the other hand, alloy D made according to the invention again produces results better than those of the two conventional alloys A and C, which is materialized by a much larger number of spheroids however may be the casting masses. Higher contents of ferrite result in the structures and, consequently, by way of example, much lower hardness values, as indicated in the last column of Table II. The results of casting A4 given in Table II prove that the addition of rare earths and Bismuth in concentrated form has no noteworthy inoculating effect.

The behaviour of the alloys on the fading of the inoculating effect has also ben studied in a third series of castings.

Sheets 6 mm thick were cast at different maintenance times, after inoculation. 200 kg of liquid cast metal were treated with magnesium at 1550° C. in the furnace, adding 1.1% of the same alloy to the Ni and Mg without rare earths, as that used in the first series of tests. The total addition of inoculating agent is 1% of which half was added during transfer of the cast metal from the furnace into the casting ladle and the other just before the first sheet is cast. At that moment, the temperature of the metal was 1440°–1445° C. Alloy B according to the invention was compared with a ferroalloy E with 0.57% Ca; 0.2% Al; 0.42% rare earths and 71% Si; remainder: Fe. The final chemical composition of the cast metal differs from that of the first two series of tests only by a higher carbon equivalent. This final composition of the cast iron is given in Table III hereinbelow.

TABLE III

| No. of casting | Inoculating agent | Composition of the cast iron % C | % Si | % Mg | % Ni |
|---|---|---|---|---|---|
| B 1 | alloy E | 3.80 | 2.85 | 0.051–0.045 | 0.93 |

TABLE III-continued

| No. of casting | Inoculating agent | Composition of the cast iron | | | |
|---|---|---|---|---|---|
| | | % C | % Si | % Mg | % Ni |
| B 2 | alloy B | 3.86 | 2.92 | 0.052–0.045 | 0.91 |

The results of the tests are indicated in Table IV hereinbelow where N represents the mean number of spheroids per square millimeter in 6 mm thick sheets, P the content of pearlite, in percentage, in these sheets, $t_C$ the casting time after inoculation, in minutes, and T the temperature of casting in °C., measured in the ladle.

TABLE IV

| No. of casting | | No. of sheet | | | | | | |
|---|---|---|---|---|---|---|---|---|
| | | 1 | 2 | 3 | 4 | 5 | 6 | 7 |
| B 1 | $t_C$ | 0 | 1 | 3 | 5 | 7 | 9 | 11 |
| | N | 401 | 230 | 207 | 210 | 230 | 231 | 247 |
| Inoculating agent | P | 21.9 | 43.8 | 44.6 | 46.9 | 46.9 | 46.7 | 46.5 |
| E | 1 | 1444 | 1436 | 1424 | 1412 | 1396 | 1384 | 1370 |
| B 2 | $t_C$ | 0 | 1 | 3 | 5 | 8 | 11 | |
| | N | 1275 | 523 | 433 | 354 | 344 | 330 | |
| Inoculating agent | P | 0.5 | 22.5 | 29.2 | 30.1 | 32.3 | 31.2 | |
| B | T | 1445 | 1435 | 1425 | 1410 | 1390 | 1372 | |

Figure 2:
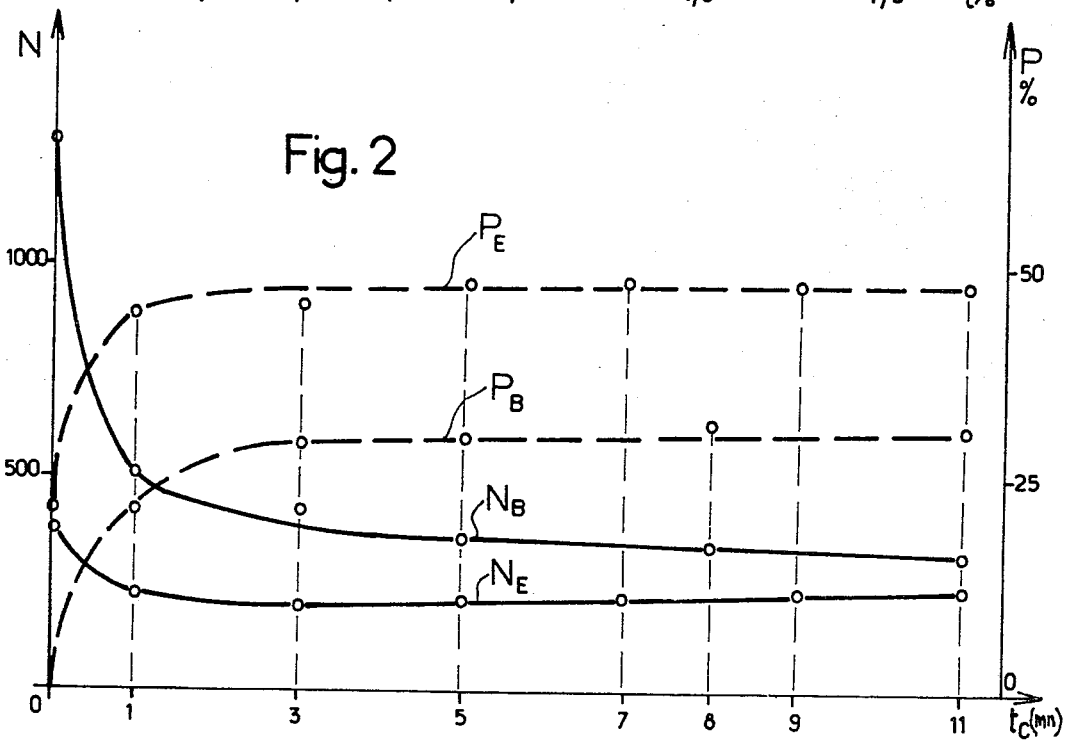
FIG. 2 is a diagram illustrating the variation of the mean number of spheroids per square millimeter and of the percentage of pearlite, as a function of the maintenance time after inoculation, respectively in the case of a conventional agent and of an inoculating agent according to the invention.

In FIG. 2, curves $P_B$ and $P_E$ on the one hand, and $N_B$ and $N_E$ on the other hand, indicate respectively the variation of the number of spheroids N and the content of pearlite P in the case of the alloy B according to the invention and of the alloy E of conventional composition.

Table IV and FIG. 2 illustrate the more favourable effect of the inoculation agent B on the structure in the low-mass moulds; in fact, higher numbers of spheroids are obtained during the whole casting period as well as much lower rates of pearlite.

What I claim is:

1. A ferroalloy for the treatment by inoculation of cast metals with spheroidal graphite comprising from 0.005 to 3% by weight of at least one metal of the rare earth group and from 0.05 to 3% by weight of at least one element taken from the group consisting of bismuth, lead and antimony, the remainder being essentially silicon and the balance iron.

2. A process for treating the liquid cast iron with a ferroalloy according to claim 1 as unique inoculating treatment, wherein well-metered quantities of rare earth metals with well-metered quantities of bismuth, lead or antimony are added, after the spheroidizing treatment of the cast iron, so that the sum of the rare earth metal elements is included between 0.005% and 0.1% weight of the cast iron, whilst the sum of the elements bismuth, lead and antimony represents between 0.005% and 0.05% by weight of the cast metal.

3. The ferroalloy of claim 1, wherein silicon is present in the amount of 71%.

4. The ferroalloy of claim 1, wherein silicon is present in the amount of 72%.

5. The ferroalloy of claim 1, which contains 0.59% Ca, 0.23% Al, 0.44% rare earths, 0.49% Bi and 71% Si.

6. The ferroalloy of claim 1, which contains 0.9% Ca, 0.2% Al, 0.74% rare earths, 1.45% Bi and 72% Si.

7. The process of claim 2 in which the ferroalloy contains 0.9% Ca, 0.2% Al, 0.74% rare earths, 1.45% Bi and 72% Si.

8. The process of claim 2 in which the ferroalloy contains 0.59% Ca, 0.23% Al, 0.44% rare earths, 0.49% Bi and 71% Si.

9. The ferroalloy of claim 2 wherein silicon is present in the range of 71–72%.

10. The ferroalloy of claim 1, wherein the sum of the rare earth elements included after the spheroidizing treatment of the cast alloy is between 0.005% and 0.1% by weight of the cast metal, and the sum of the elements bismuth, lead and antimony is between 0.005% and 0.05% by weight of the cast metal.

* * * * *